US007203988B2

(12) United States Patent
Laux et al.

(10) Patent No.: US 7,203,988 B2
(45) **Date of Patent: *Apr. 17, 2007**

(54) BROOM WITH SCUFF REMOVER

(75) Inventors: Christopher J. Laux, Hamilton, OH (US); Andrew B. Mendenhall, Indianapolis, IN (US)

(73) Assignee: Freudenberg Household Products LP, Northlake, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/103,346

(22) Filed: Apr. 11, 2005

(65) Prior Publication Data

US 2006/0048320 A1 Mar. 9, 2006

Related U.S. Application Data

(63) Continuation of application No. 10/747,987, filed on Dec. 30, 2003, now Pat. No. 6,877,181.

(60) Provisional application No. 60/439,244, filed on Jan. 10, 2003.

(51) Int. Cl.
*A47L 13/12* (2006.01)

(52) U.S. Cl. ..... 15/114; 15/246; D4/116; D32/42; D32/50

(58) Field of Classification Search ..... 15/105, 15/106, 114, 118, 229.11, 229.13, 246; D4/116, D4/119, 120; D32/42, 50–52
See application file for complete search history.

(56) References Cited

U.S. PATENT DOCUMENTS 552,462 A 12/1895 Beiser
665,632 A 1/1901 Finiels
748,370 A 12/1903 Harris
1,083,860 A 1/1914 Robertson
1,553,915 A 9/1925 Rix et al.
1,600,070 A 9/1926 Serva
1,633,898 A 6/1927 Lisi
1,655,309 A 1/1928 Bose
2,080,334 A 5/1937 Petrovsky
3,414,928 A 12/1968 Lemelson
3,750,218 A 8/1973 Rosocha
4,167,796 A 9/1979 DePamphilis
4,491,998 A 1/1985 Wilson et al.
D282,604 S 2/1986 Whitaker
4,654,920 A 4/1987 O'Neil, Jr. et al.
4,675,932 A 6/1987 Hofacker, Jr.
4,967,441 A 11/1990 White
D368,164 S 3/1996 Reeder (Continued)

*Primary Examiner*—Mark Spisich
(74) *Attorney, Agent, or Firm*—Calfee, Halter & Griswold LLP

(57) ABSTRACT

A multipurpose cleaning implement that functions both as a broom and a scuff removing device. The exemplary embodiment of the present invention includes a plastic base that serves as the attachment point for (i) a plurality of bristles (ii) a handle, and (iii) a device that is useful for removing scuff marks from floors. A first general embodiment of the scuff removing device includes a friction forming material that has been attached to a base or support that includes a rounded or curved forward surface. A second general embodiment of the scuff removing device includes a detachable scuff remover that includes a piece of friction forming material mounted on a base which may be clipped to the end of a broom handle opposite the broom head.

11 Claims, 5 Drawing Sheets

U.S. PATENT DOCUMENTS 5,613,897 A 3/1997 Thompson, Jr.
5,709,003 A 1/1998 Batch
5,784,746 A 7/1998 Williams et al.
6,081,958 A 7/2000 Van Staagen
6,178,581 B1 1/2001 Lewis
6,202,246 B1 3/2001 Boucher
6,216,307 B1 4/2001 Kaleta et al.

BROOM WITH SCUFF REMOVER

CROSS-REFERENCE TO RELATED APPLICATIONS

This patent application is a continuation of application Ser. No. 10/747,987, filed on Dec. 30, 2003, now U.S. Pat. No. 6,877,181 B2.

This patent application claims the benefit of U.S. Provisional Patent Application Ser. No. 60/439,244 filed on Jan. 10, 2003 and entitled "Broom with Scuff Remover," the disclosure of which is incorporated as if fully rewritten herein.

TECHNICAL FIELD OF THE INVENTION

The present invention relates generally to cleaning implements for industrial or home use, and more specifically to a conventional broom that includes an implement useful for removing scuff marks from floors.

STATEMENT REGARDING FEDERALLY FUNDED RESEARCH

This invention was not made by an agency of the United States Government nor under contract with an agency of the United States Government.

BACKGROUND OF THE INVENTION

Brooms and mops are commonplace cleaning devices that have been commercially available for many years. The usefulness and effectiveness of such cleaning implements is undisputed and many examples of variations on the basic design of the broom and the mop are found in the prior art. Numerous versions of mops that include both a mop head (fiber, sponge, or other material) and a separate scrubbing pad are also found in the patent prior art. While these devices may be useful for cleaning some surfaces, the scrubber pad is not typically effective or appropriate for use on surfaces such as hardwood or laminate floors.

Hardwood and laminate floors are often particularly susceptible to scuff marks left by shoes with rubber soles. These scuff marks are unsightly and are often quite difficult to remove, even when a mild cleaner or solvent is applied to the scuff mark. The average broom or mop is not effective for scuff removal purposes, so after any loose material has been swept away, the person cleaning the floor must find another means for removing any scuff marks that have been left on the surface being cleaned. Thus, removing scuff marks can prove to be a very inconvenient and often frustrating task. Therefore, there is a need for a single integrated cleaning device that includes both a general cleaning head, such as a broom head, and a secondary cleaning surface useful for removing scuff marks.

SUMMARY OF THE INVENTION

These and other deficiencies of the prior art are overcome by the present invention which provides a multipurpose cleaning implement that functions both as a broom and a scuff removing device. The exemplary embodiment of the present invention includes a plastic base that serves as the attachment point for a number of other components. A plurality of bristles is attached to the bottom side of the base, preferably in a wedge-shaped configuration. An elongated handle is typically attached to the uppermost or top portion of the base. Thus, the cleaning implement of the present invention includes the basic features required for it to function as a standard broom. However, this invention also includes a second cleaning implement, namely a scuff removing device that is useful for removing scuff marks from floors.

A first general embodiment of the scuff removing device includes a friction forming material, such as, for example, a piece of tennis ball material, that has been attached to a base or support that includes a rounded or curved forward surface. This subassembly may be permanently attached to the front portion of the broom base, which in the exemplary embodiment is specifically formed to receive the scuff remover subassembly, or alternately, the scuff remover may be clipped or otherwise detachably connected to the front, back, or even side portions of the base of the broom. A second general embodiment of the scuff removing device includes a detachable scuff removing device that includes a piece of friction forming material, such as the outer material of a tennis ball, mounted on a base which may be clipped to the end of a broom handle opposite the broom head.

Further advantages of the present invention will become apparent to those of ordinary skill in the art upon reading and understanding the following detailed description of the preferred embodiments.

BRIEF DESCRIPTION OF THE DRAWINGS

The accompanying drawings, which are incorporated into and form a part of the specification, schematically illustrate one or more exemplary embodiments of the invention and, together with the general description given above and detailed description of the preferred embodiments given below, serve to explain the principles of the invention.

DETAILED DESCRIPTION OF THE INVENTION

Figure 1:
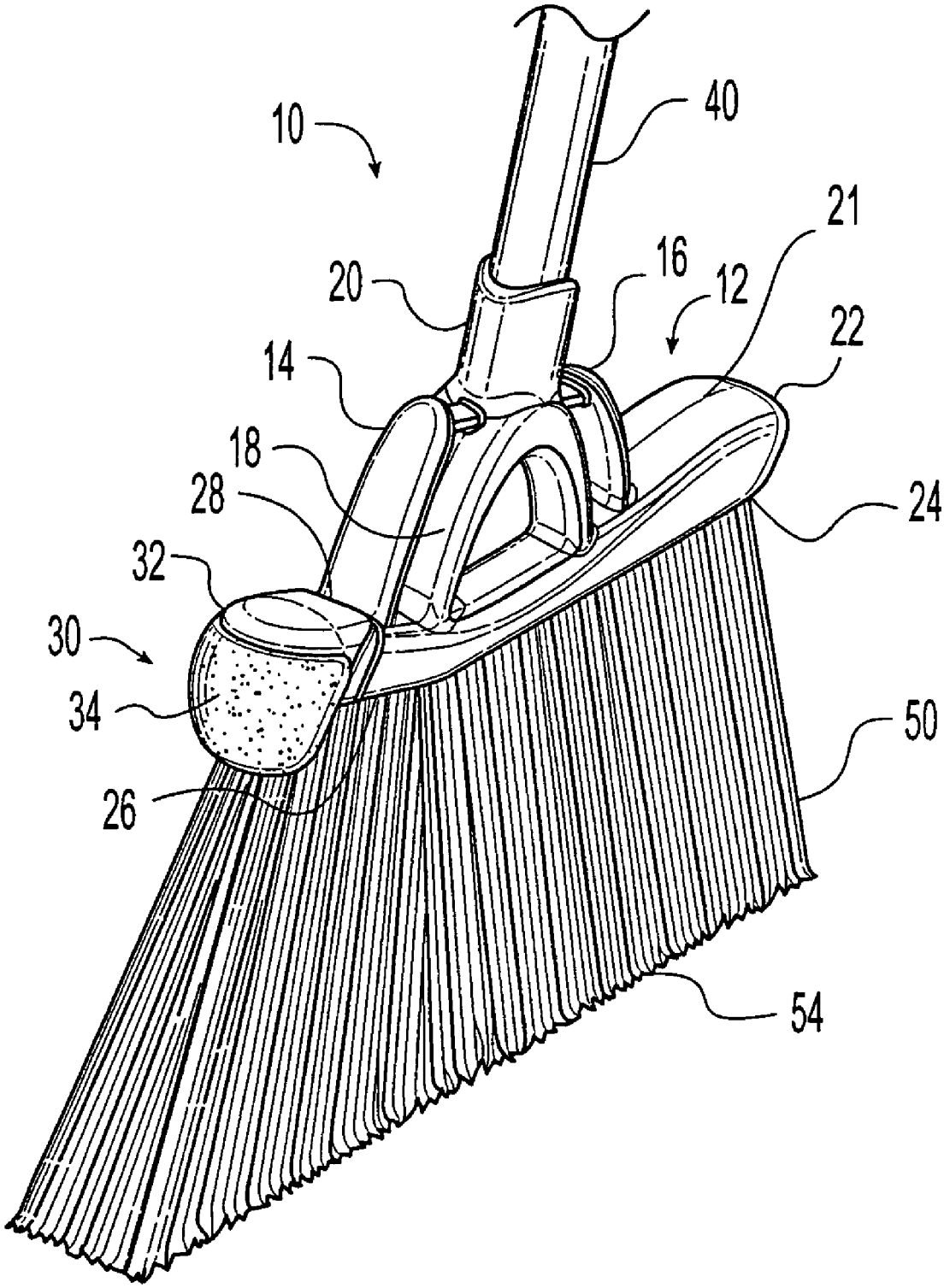
FIG. 1 is a perspective view of one side of the combination broom and scuff remover of the present invention.

The present invention provides a multi-purpose cleaning implement, the exemplary embodiment of which includes a conventional broom head and a second cleaning head or device for removing scuff marks from the surface being cleaned. With reference to the Figures, FIG. 1 is a perspective view of one side of the exemplary embodiment showing the various components of cleaning implement 10. Cleaning implement 10 includes a base 12 which receives broom handle 40 and bristles 50 as well as scuff remover subassembly 30.

Figure 2:
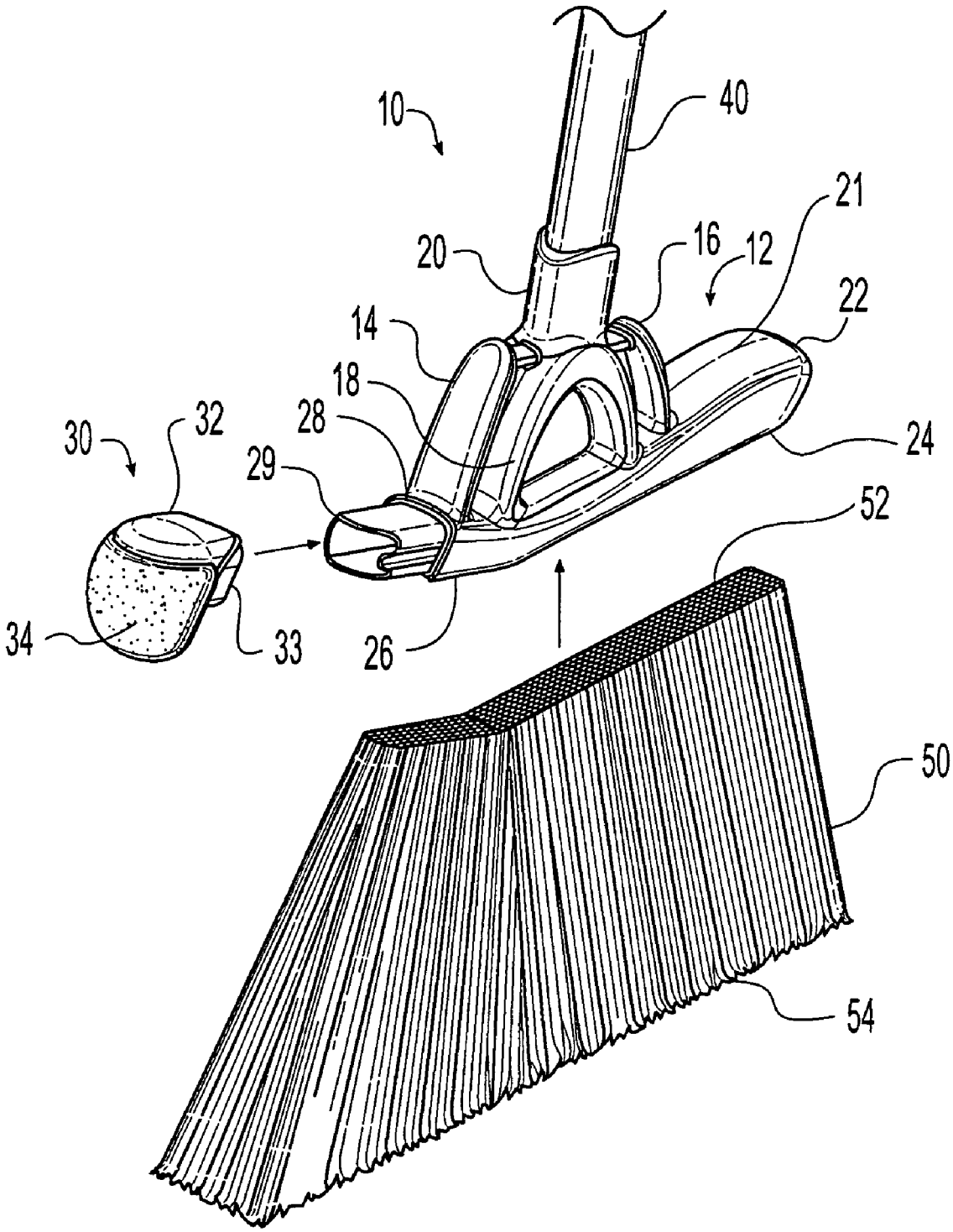
FIG. 2 is an exploded perspective view of one side of the combination broom and scuff remover of FIG. 1.
Figure 5:
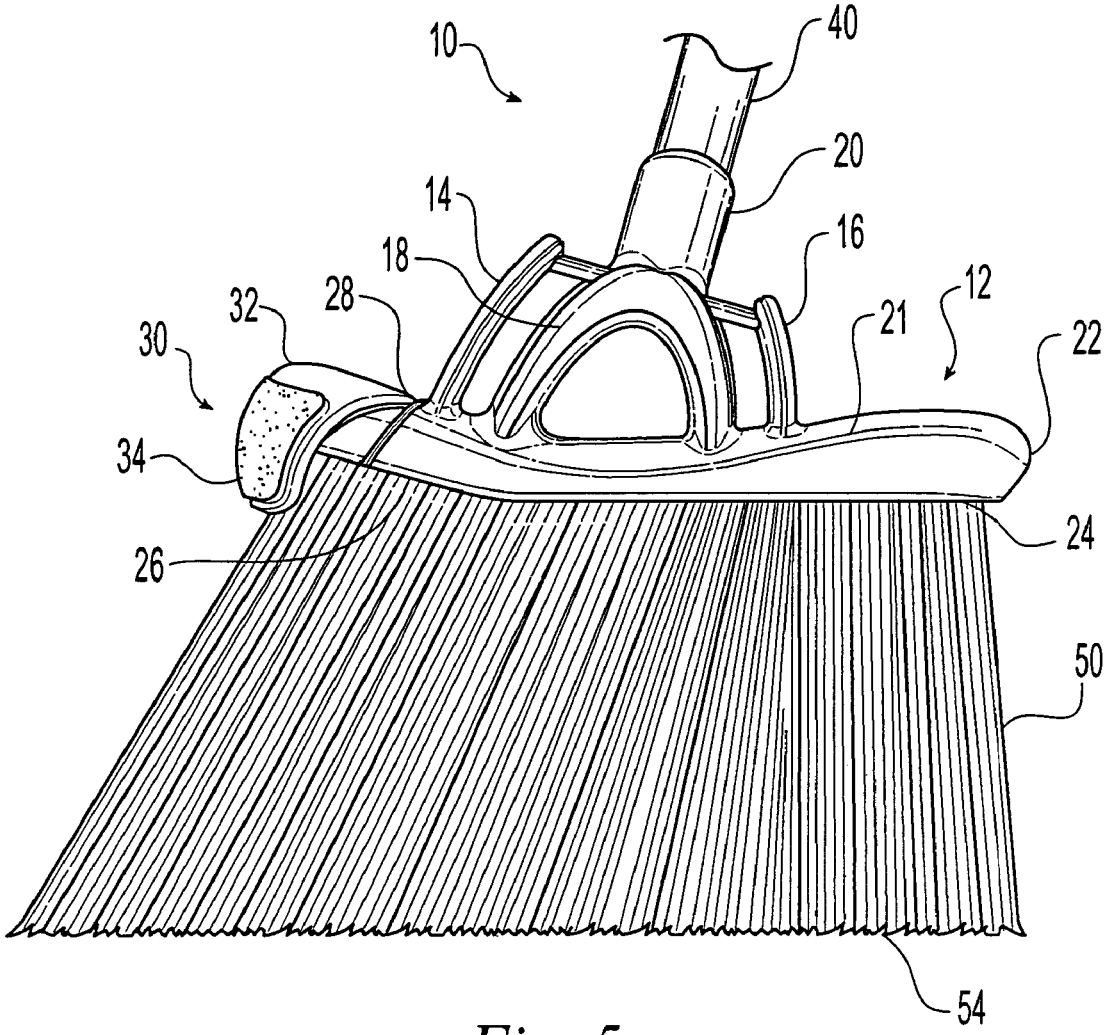
FIG. 5 is a side-view of the combination broom and scuff remover of FIG. 1.
Figure 6:
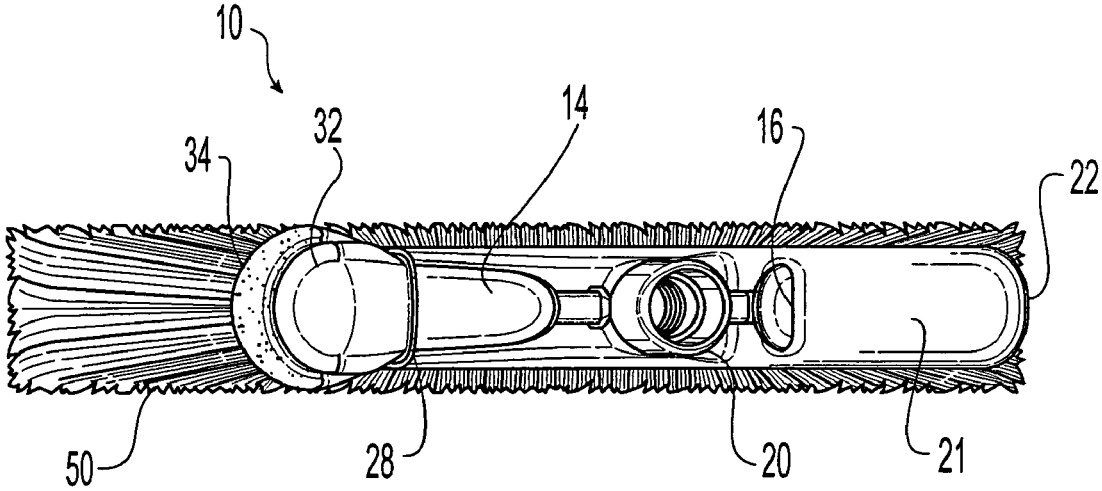
FIG. 6 is a top-view of the combination broom and scuff remover of FIG. 1.
Figure 7A:
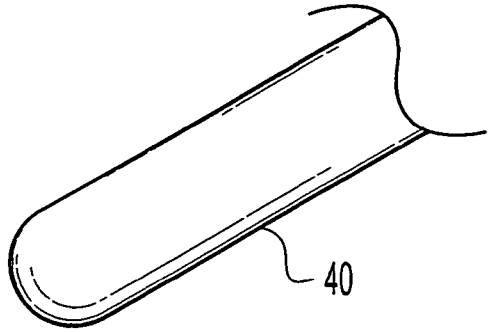
FIG. 7*a* is a perspective view of the end of a broom handle.
Figure 7B:
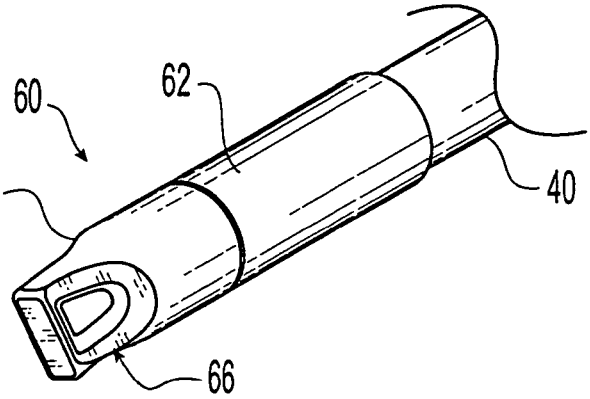
FIG. 7*b* is a perspective view of a broom handle that includes an attachment for hanging the broom from a hook, nail, or similar device.
Figure 7C:
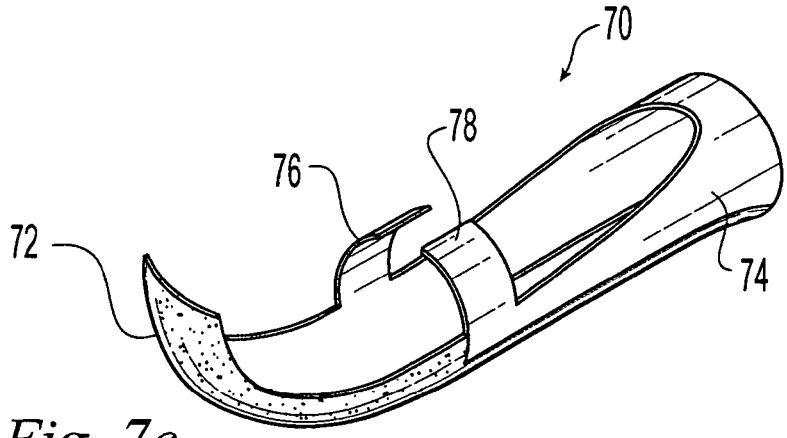
FIG. 7*c* is a perspective view of the embodiment of the present invention that includes a scuff removing device which is mountable on the end of the broom handle of FIG. 7*a* or 7*b*.

As best shown in FIGS. 1, 2 and 5, base 12 further includes first support 14, second support 16, and center support 18 all of which are formed integrally with body 21 and provide structural support to base 12. Collar 20 is formed integrally with center support 18 and, as shown in FIG. 6, may be threaded internally to correspond to threads (not shown) formed on broom handle 40. Thus, in the exemplary embodiment, broom handle 40 is threaded into collar 20 and tightened to provide a means by which the end user of cleaning implement 10 may manipulate the device.

In addition to providing the attachment point for the broom handle, base 12 also provides the surfaces to which a plurality of bristles 50 are attached. As shown in FIGS. 1 and 2, top edge 52 of bristles 50 is attached to the first attachment surface 24 and second attachment surface 26, both of which are formed on the underside of body 21. In the exemplary embodiment, the attachment surfaces are angled slightly in relation to one another for the purpose of creating the wedge-shaped body of bristles shown in the Figures. The slightly upturned face of second attachment surface 26 allows the front edge of the bristle group or body to be angled outward, thereby increasing overall length of bottom edge 54. Likewise, the slight angle of first attachment surface 24 allows the rear edge of the bristle group or body to be angled outward from the central axis of cleaning implement 10 to further increase the overall length of bottom edge 54.

As will be appreciated by those skilled in the art, bristles 50 can be manufactured by and attached to base 12 by any number of known processes. Bristles 50 can be manufactured from a variety of materials including, for example, vinyl, plastic, and straw. Base 12 is typically molded plastic or polymer and may be manufactured using any of a variety of known manufacturing techniques.

Figure 3:
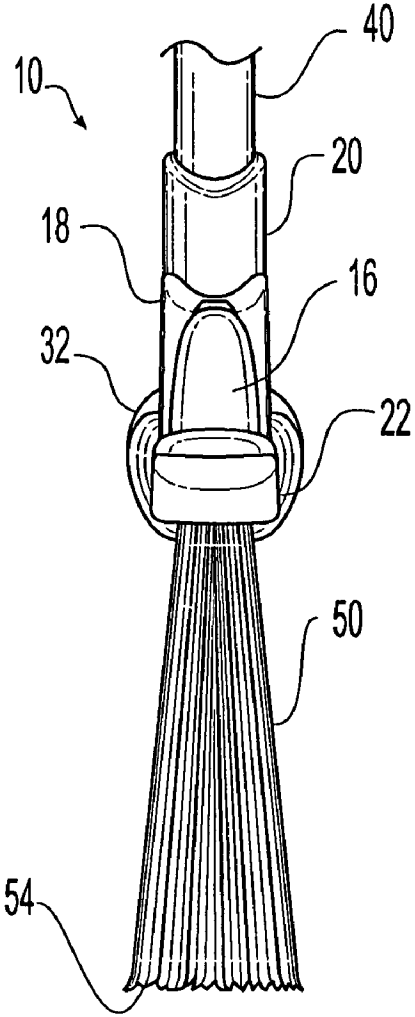
FIG. 3 is a rear-view of the combination broom and scuff remover of FIG. 1.

Again with reference to FIGS. 1 and 2, the exemplary embodiment of base 12 further includes contoured neck 29 which is formed to receive scuff remover subassembly 30. As best shown in FIG. 2, scuff remover subassembly 30 is attachable to or mountable on neck 29. Neck 29 is formed to correspond to the shape of collar 33 and scuff remover subassembly 30 is mounted on base 12 by engaging these two structural members. Scuff remover subassembly 30 is correctly mounted on body 21 when it is pushed forward such that it contacts ridge 28. Scuff remover subassembly 30 may be mounted on base 12 permanently, or it may be detachable. In alternate embodiments of the present invention, scuff remover subassembly 30 is mountable on the rear portion 22 (see FIG. 3) of body 21. In some embodiments of the present invention, scuff remover subassembly 30 is a disposable item that may be replaced when it is no longer effective at removing scuff marks.

Figure 4:
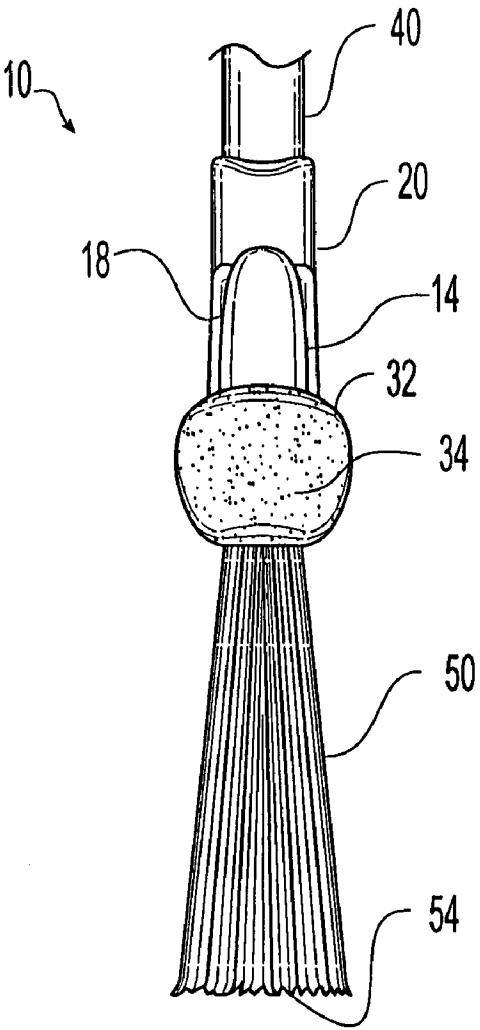
FIG. 4 is a front-view of the combination broom and scuff remover of FIG. 1.

Scuff remover subassembly 30 includes base 32, collar 33, and cleaning surface 34. As shown in FIGS. 1–2 and 5–6, an exemplary embodiment of base 32 includes a forward-facing, curved surface area that serves as the substrate to which cleaning surface 34 is attached. Cleaning surface 34 is typically a separate piece of material that is glued or otherwise bonded to the curved surface of base 32. Preferably, the material of cleaning surface 34 is polyester, acrylic, polymer, or elastomer impregnated with wool fibers, similar or even identical to the material used for tennis balls. However, other combinations of natural or synthetic fibers attached to a pliable, rubberized base are possible for use as cleaning surface 34. In an exemplary embodiment of the present invention, a piece of tennis ball material is cut to size and glued to the curved surface area of base 32 as best shown in FIGS. 2 and 4. However, it should be noted that any material that forms friction sufficient to remove scuff marks from the floor or other surface to be cleaned is compatible with this invention.

Cleaning implement 10 offers the user two separate but integrated devices or tools for cleaning surfaces such as hardwood, laminate, tile, linoleum, or concrete floors. The user may remove loose dust and dirt by sweeping the surface in the typical manner. To remove scuff marks from the surface, the user simply rotates the handle of the cleaning implement 10 to turn base 12 such that cleaning surface 34 of scuff remover subassembly 30 is touching the surface to be cleaned. By applying force in a downward and back and forth or side-to-side manner, the scuff mark may be removed.

Figure 8:
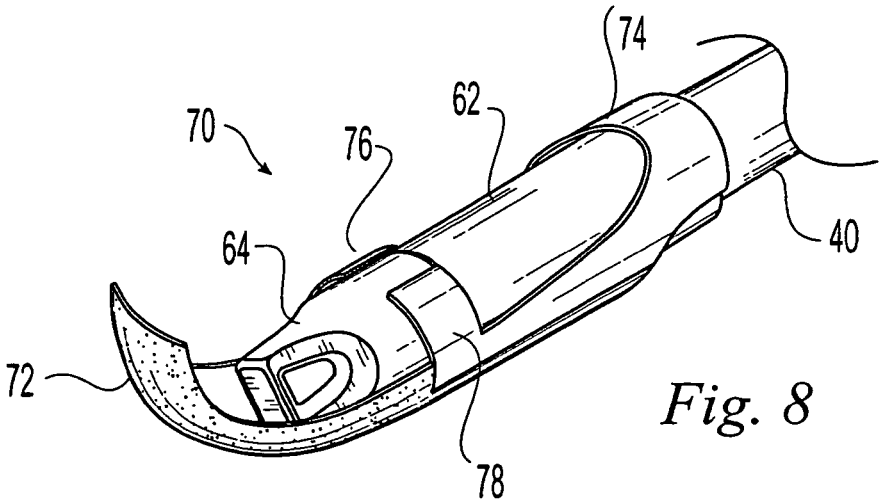
FIG. 8 is a perspective view of the scuff remover attachment of FIG. 7*c*

An alternate embodiment of the present invention is shown in FIGS. 7*a* –*c* and FIG. 8. This embodiment of the present invention includes an attachment 70 that has been formed to fit on the end of the broom handle opposite base 12. Attachment 70 includes cleaning surface 72 for removing scuff marks, and bracket 74 and first and second arms 76 and 78 respectively for securing attachment 70 to the broom handle. This detachable embodiment is compatible with bare wood handles such as that shown in FIG. 7*a*, as well broom handles that include a hanger subassembly 60 such as that shown in FIG. 7*b*. An exemplary embodiment of hanger subassembly 60 includes collar 62, swivel collar 64, and an aperture 66 for receiving a nail, hook, or other device for hanging the broom. As shown in FIG. 8, attachment 70 simply clips onto handle 40 and fits securely on top of hanger subassembly 60 as shown in the drawing.

Attachment 70 is used by simply clipping the device to the broom handle and flipping the entire broom over such that cleaning surface 72 is touching the surface to be cleaned. By applying force in a downward and back and forth or side-to-side manner, the scuff mark may be removed.

While the above description contains many specificities, these should not be construed as limitations on the scope of the invention, but rather as exemplification of certain preferred embodiments. Numerous other variations of the present invention are possible, and is not intended herein to mention all of the possible equivalent forms or ramifications of this invention. Various changes may be made to the present invention without departing from the scope or spirit of the invention.

The invention claimed is:

1. A cleaning implement, comprising:

(a) a broom, wherein the broom further comprises:

(i) a base;

(ii) a plurality of bristles attached to the base; and (iii) an elongated handle attached the base;

(b) a scuff removing device attachable the base or to the elongated handle, wherein the scuff removing device further comprises:

(i) a support adapted to be attached to one of the base and the elongated handle, wherein the support further comprises a contoured surface; and (ii) a friction forming material attached to the contoured surface, wherein the friction forming material further comprises a substrate, and wherein at least a portion of the substrate further comprises natural fibers, synthetic fibers, or a combination thereof.

2. The cleaning implement of claim 1, wherein the base further comprises a collar for receiving the elongated handle, and wherein the collar further comprises a plurality of internal threads.

3. The cleaning implement of claim 1, wherein the base further comprises a contoured neck adapted to receive the scuff removing device.

4. The cleaning implement of claim 1, wherein the plurality of bristles is attached to the base substantially in the shape of a wedge, and wherein the length of the bottom portion of the wedge is greater than the length of the top portion of the wedge.

5. The cleaning implement of claim 1, wherein the friction forming material further comprises tennis ball material.

6. The cleaning implement of claim 1, wherein the scuff removing device further comprises at least one clip for attaching the scuff removing device to the elongated handle.

7. The cleaning implement of claim 1, wherein the scuff removing device is a disposable item that may be removed from the cleaning implement.

8. An implement for cleaning floors, comprising:

(a) a broom, wherein the broom further comprises:

(i) a base;

(ii) a plurality of bristles attached to the base; and (iii) an elongated handle attachable to the base; and (b) a scuff removing device, wherein the scuff removing device further comprises:

(i) a support formed integrally with the base or attached to the elongated handle, and wherein the support further comprises a contoured surface; and (ii) a friction forming material attached to the contoured surface, wherein the friction forming material further comprises a pliable substrate, and wherein at least a portion of the substrate further comprises natural fibers, synthetic fibers, or a combination thereof.

9. The cleaning implement of claim 8, wherein the base further comprises a collar for receiving the elongated handle, and wherein the collar further comprises a plurality of internal threads.

10. The cleaning implement of claim 8, wherein the plurality of bristles is attached to the base substantially in the shape of a wedge, and wherein the length of the bottom portion of the wedge is greater than the length of the top portion of the wedge.

11. The cleaning implement of claim 8, wherein the friction forming material further comprises tennis ball material.

* * * * *